United States Patent [19]

Reuter et al.

[11] Patent Number: 4,882,974

[45] Date of Patent: Nov. 28, 1989

[54] METHOD FOR INCREASING THE HITTING PROBABILITY OF MULTI-BARREL MACHINE WEAPONS

[75] Inventors: Ingolf Reuter, Dornhan; Dietrich Hoffmann, Schramberg; Harald Weisser, Oberndorf, all of Fed. Rep. of Germany

[73] Assignee: Mauser-Werke Oberndorf GmbH, Oberndorf, Fed. Rep. of Germany

[21] Appl. No.: 285,332

[22] Filed: Dec. 14, 1988

Related U.S. Application Data

[63] Continuation of Ser. No. 68,431, Jun. 30, 1987, abandoned.

[30] Foreign Application Priority Data

Jul. 12, 1986 [DE] Fed. Rep. of Germany ..... 3623650

[51] Int. Cl.[4] ..... F41G 3/04

[52] U.S. Cl. ..... 89/41.16; 89/41.13; 89/1.41

[58] Field of Search ..... 89/127, 1.41, 9, 11, 89/12, 13.05, 41.13, 41.16, 41.19, 41.03

[56] References Cited

U.S. PATENT DOCUMENTS

| | | | |
|---|---|---|---|
| 1,311,860 | 7/1919 | Holzworth | 89/1.41 |
| 1,330,776 | 2/1920 | Ardouin | 89/41.16 |
| 1,353,267 | 9/1920 | Pierce | 89/9 |
| 1,448,587 | 3/1923 | Arntzen | 89/1.41 |
| 1,551,809 | 9/1925 | Dodge, Jr. | 89/1.41 |
| 3,897,714 | 8/1975 | Perrin et al. | 89/1.41 |
| 4,244,272 | 1/1981 | Terry et al. | 89/41.16 |
| 4,712,181 | 12/1987 | Dahlberg | 89/41.16 |

FOREIGN PATENT DOCUMENTS

| | | | |
|---|---|---|---|
| 887876 | 11/1943 | France | 89/41.13 |
| 352188 | 11/1937 | Italy | 89/1.41 |
| 190192 | 7/1937 | Switzerland | 89/41.16 |

OTHER PUBLICATIONS

Bruchiss, Aviation, 5/41, pp. 44, 45, 146 and 148, vol. 40, No. 5.

*Primary Examiner*—Deborah L. Kyle
*Assistant Examiner*—Stephen Johnson
*Attorney, Agent, or Firm*—Scully, Scott, Murphy & Presser

[57] ABSTRACT

A method for increasing the hitting probability of multi-barreled machine weapons, especially for four-gun or gatling-type weapon systems. Through a spreading apart of the middle of hitting point locations of the individual weapon barrels, there can be achieved an improvement in the characteristics of the firing spread. This is attained in that the middle hitting point location of the individual weapon barrels is spread apart in such a manner about the middle hitting point location of all of weapon barrels of a weapon system, that the density of hits remains almost constant at a restrictedly increasing deviation from the middle of the hitting point location of all the weapon barrels. The middle hitting point location of the individual weapon barrels can be spread apart by the amount of the average standard deviation of the diring spread of the individual weapon barrels from the middle hitting point location of all weapon barrels of a weapon system.

1 Claim, 5 Drawing Sheets

METHOD FOR INCREASING THE HITTING PROBABILITY OF MULTI-BARREL MACHINE WEAPONS

This application is a continuation of application Ser. No. 068,431 filed June 30, 1987, now abandoned.

BACKGROUND OF THE INVENTION

1. Field of the Invention

The present invention relates to a method for increasing the hitting probability of multi-barreled machine weapons, especially of four-gun or gatling-type weapon systems.

2. Discussion of the Prior Art

In the multi-barrel machine weapon systems which are in current use, it has heretofore been the intention to coincide the middle or central positions of the target impact points of the individual weapon barrels with an average firing or combat distance of, for example, 500 to 2,000 meters. As a result, there is obtained a relatively narrowly restricted overall firing pattern or firing spread circle for the weapons. However, because of the imprecision of the firing control and in the weapon installation itself which is always encountered, as a rule, the middle impact point, mostly likely, will not coincide with the target. This disadvantage renders itself especially inexpediently or negatively noticeable with moving targets. The hitting expectancy is relatively low for this system. Through an increase in the firing spread of individual weapons there can be achieved a certain increase in the hitting expectancy at target offsets or deviations; however, the chances for hits will constantly drop off with an increase in the deviation or offset from the middle hitting point.

From the disclosure of German Pat. No. 24 39 250 there has become known an arrangement for the remote-controlled setting of the firing spread area or pattern for a gun of the gatling-type class of construction. In this instance, provided at the end of every gun run is a muzzle brace having a surface which engages each one of the gun runs, which extends at an angle relative to the longitudinal axis of the respective gun run. Through the provision of a control device on the housing it is possible to impart a lateral orientation to the weapon barrel or gun runs. This known machine weapon contains a cluster of rotatable gun barrels, by means of which, in the normal instance, there is achieved a narrowly confined spread for the firing hits.

Thus, through an adjustment of the gun barrels there can be achieved a relatively moderate spread as well as an extremely large spread for the firing hits. When the spread is selected so as to be large, there will then be encountered firing hits which are in the configuration of an annular or ring-shaped band with an open central area which is not hit. The German Pat. No. 24 39 250 fails to provide any solution in the attempt achieve an increase in the hitting probability of multi-barreled machine weapons with fixedly-positioned weapon barrels.

SUMMARY OF THE INVENTION

Accordingly, it is an object of the present invention to provide a method for an increase in the hitting probability of multi-barreled machine weapons, and especially those of four-gun or gatling-type weapon systems, in which through a spreading apart of the middle of the hitting point locations of the individual weapon barrels, there can be achieved an improvement in the characteristics of the firing spread or pattern.

Inventively, the foregoing object is attained in that the middle hitting point location of the individual weapon barrels is spread apart in such a manner about the middle hitting point location of all of the weapon barrels of a weapon system, that the density of hits remains almost constant at a restrictedly increasing deviation from the middle of the hitting point location of all of the weapon barrels.

Pursuant to a specific feature of the invention, the middle hitting point location of the individual weapon barrels can be spread apart by the amount of the average standard deviation of the firing spread of the individual weapon barrels from the middle hitting point location of all weapon barrels of a weapon system.

In accordance with a specific embodiment of the invention, the weapon system can be constituted of four individual weapon barrels, which are arranged at the same distance or offset about the middle hitting point location of all weapon barrels of the weapon system, whereby the individual weapon barrels can be spread apart by the extent of the standard deviation towards the side and height from the middle hitting point location of all weapon barrels of the weapon system, and the selected spreading apart can be imparted to the weapon system as a fixedly set magnitude.

Due to the spreading apart of the firing hitting point location of the individual weapon barrels, in a simple manner there is thus achieved an improvement in the firing spread characteristics, in that the closeness of the hits will remain almost constant at an increasing offset or distance from the middle hitting point up to a certain deviation or distance. Whereas it is advantageous for pin-point targets to spread apart the weapon barrels by the amount of the average firing spread, for large-surfaced targets it can be more advantageous to select the barrel spread to be somewhat larger.

In one attempt, there was calculated the probability of firing hits possessing a firing cadence for the individual weapons of 1500 shots per minute. In this attempt, there was commenced from a target surface of 2 m×2 m in size at a firing distance of 1,000 m and a firing period of two seconds. Initially it was assumed that all weapon barrels fire against one pin-point. During the further course, the individual weapon barrels were spread apart by the amount of the standard deviation of 3 mrad towards the side and height from the middle hitting point location for all weapon barrels. Indicated hereby was that, up to a target deviation or offset of approximately 3.5 mrad, which correspond to approximately 3.5 m at a 1,000 m firing distance, the firing hit probability for the system without any spreading apart of the weapon barrels was higher, namely by about 100%. However, it was further evidenced that in the case of the spreading apart of the individual weapon barrels, the hitting probability was already at 99.4%, which in contrast with the first instance without any spreading apart, represented only a very minor difference. At target deviations or offsets greater than 3.5 mrad, the system possessing the spread was, however, clearly at an advantage. A 50% firing hit probability was achieved with the spreading apart at still an approximately 8.8 mrad target offset, whereby without any spreading apart there would then be achieved only an approximately 18% hitting probability. From the foregoing there can be ascertained that, by means of the inventive system, there is achieved an improvement in the hitting probability, especially for high-cadence firing multi-barreled weapon systems with target offsets or deviations which are always present because of system tolerances.

BRIEF DESCRIPTION OF THE DRAWINGS

Reference may now be had to the following detailed description of an exemplary embodiment of the invention, taken in conjunction with the accompanying drawings; in which.

DETAILED DESCRIPTION

Figure 1:
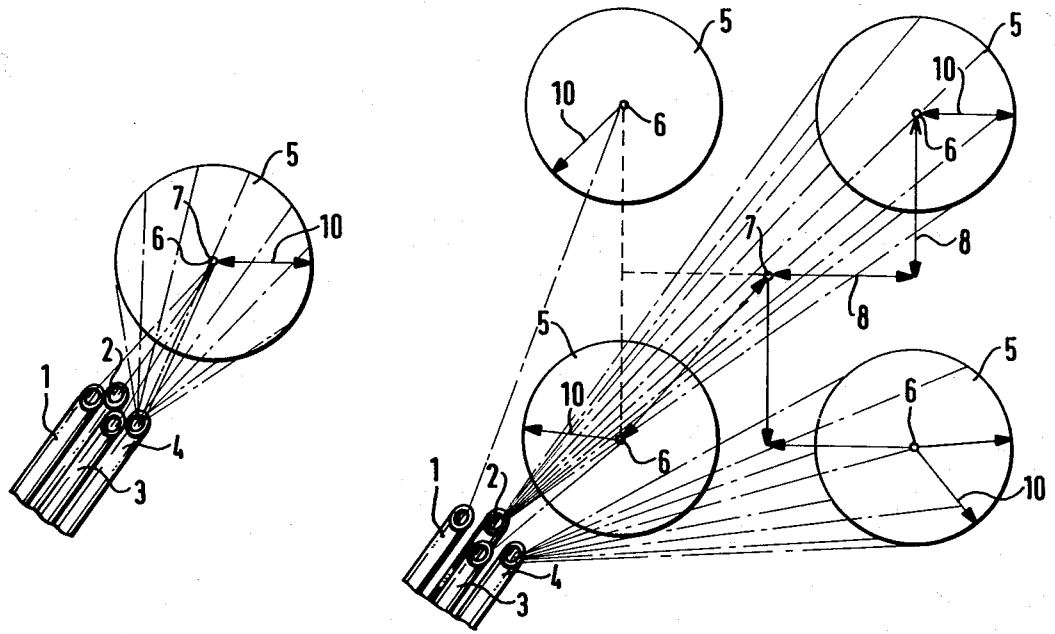
FIG. 1 illustrates, generally diagrammatically, the spread in the location of the hitting or firing impact point of the individual weapon barrels.

Illustrated towards the left side in FIG. 1, in a simplified representation, are four weapon barrels 1, 2, 3 and 4 of a multi-barreled machine or automatic weapon system, which, in accordance with the target area 5, all possess a common hitting point or firing impact location 6. This signifies that the middle or central hitting point location 7 for all weapon barrels 1, 2, 3 and 4 is, concurrently, also the hitting point location 6 for the individual weapon barrels 1, 2, 3 and 4.

In the representation of FIG. 1 towards the right side thereof, there are again shown by means of a simplified representation, the weapon barrels 1, 2, 3 and 4; however, which in this instance, are spread apart as can be ascertained from he four target areas 5. Each of these target areas 5 has a hitting point location, which is always associated with one of the respective weapon barrels 1, 2, 3 and 4. The hitting point locations 6 for the individual weapon barrels are all located at the same distance relative to each other and, further all possess the same offset 8 towards the side and height relative to the middle or central hitting point location 7 for all of the weapon barrels. The distance from the middle hitting point location of the individual weapon barrels relative to the outer bounds of the target areas 5 presently signifies the standard deviation 10 for the individual weapon barrels 1, 2, 3 and 4.

From the representation at the right side of FIG. 1, there can also be ascertained that the hitting point location 6 of the individual weapon barrels 1, 2, 3 and 4 is always spread apart by the amount of the offset or spread 8 of the individual weapon barrels relative to the middle hitting point location 7. The amount of the spread 8 can in particular be selected to as to be equal to the amount of the standard deviation 10 of the individual weapons.

Figure 2:
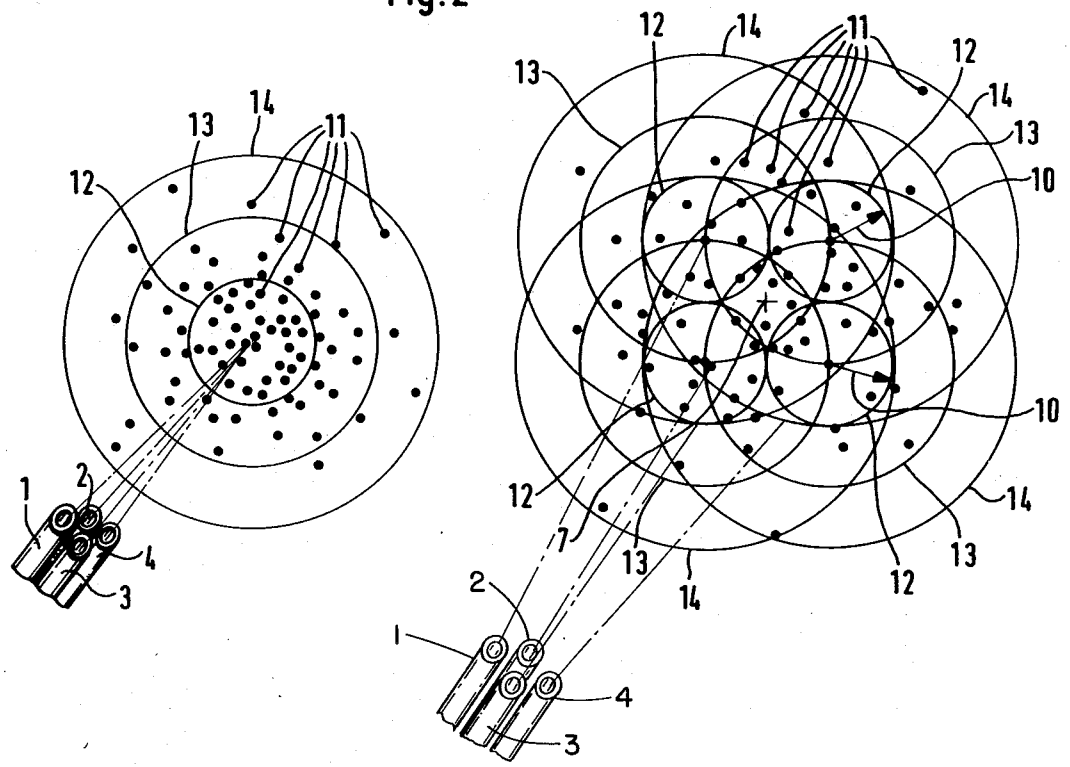
FIG. 2 illustrates the hit distribution, shown in a diagrammatic representation.

FIG. 2 illustrates the hitting distribution in correlation with the individual representations of the spread of FIG. 1. Hereby, from the left side representation of the hitting distribution or spread, there can be recognized the case in which all weapon barrels 1, 2, 3 and 4 possesses a common hitting point location. As long as there is an absence of a target offset or deviation, the expectation of firing hits is extremely high, which can be readily recognized that, in this instance, most hits 11 can be ascertained to be present within the inner ring 12 of the simple standard deviation. The number of hits in the outer rings 13 and 14 correspondingly reduces by twice to three times the standard deviation. In the right side portion of FIG. 2, the hitting point locations for the individual weapon barrels 1, 2, 3 and 4 are spread apart about by the amount of the standard deviation 10 at the width and height from the common middle hitting point location 7. In this case of the spreading apart of the individual weapon barrels, the expectation of firing hits is high when there is no offset of the target. The expectation of hits also remains high when the target offset is small; even also when the target offset becomes large within restrictive bounds. This is also maintains itself for the converse case in which the individual weapon barrels 1, 2, 3 and 4 are not spread apart, as can be ascertained from the left side illustrations in FIGS. 1 and 2.

Through a spreading apart of the hitting point locations for the individual weapon barrels 1, 2, 3 and 4 there is thus achieved an improvement in the firing spread or dispersion characteristics, in which the density of firing hits at an increasing offset from the middle hitting location remains almost constant up to a certain location. The middle hitting point location 6 of the individual weapon barrels 1, 2, 3 and 4 is spread apart by the extent of the average standard deviation of the spread of the individual weapon barrels about the middle or central hitting point location 7 for all of the weapon barrels of a weapon system.

The inventive assertion that, at higher target offsets, the system with the spread is clearly at an advantage in comparison the weapon system without spread, can be ascertained especially from FIG. 2.

Figure 3:
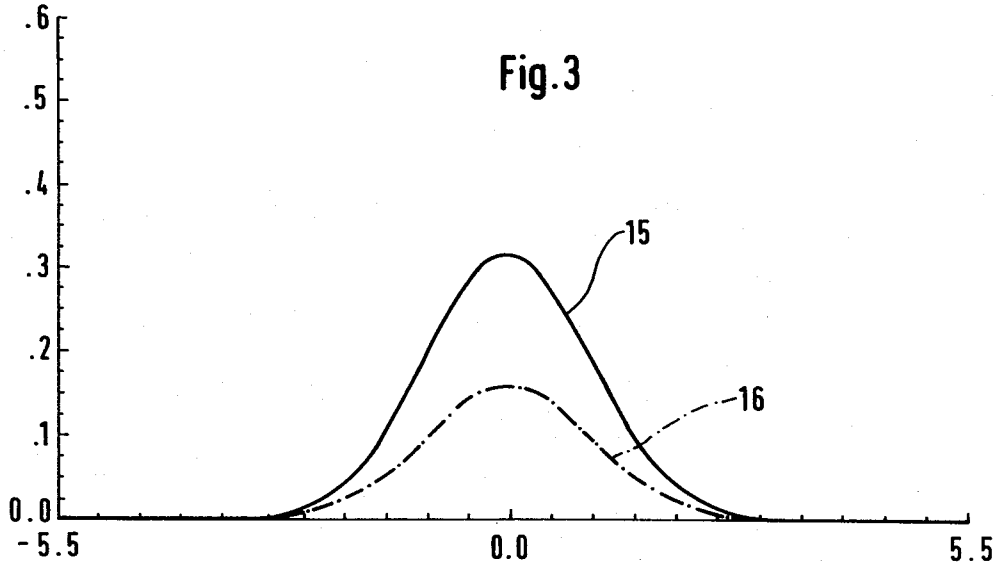
FIG. 3 illustrates a graphical representation of the hitting density for two weapons having a common firing impact point.

The graph of FIG. 3 illustrates the hitting density for two weapons possessing a common middle or central hitting point location 6. It is clearly ascertainable from this graph that the density of hits from two weapon barrels is correspondingly doubled in contrast with only one weapon barrel, as is illustrated in lines 15 and 16.

Figure 4:
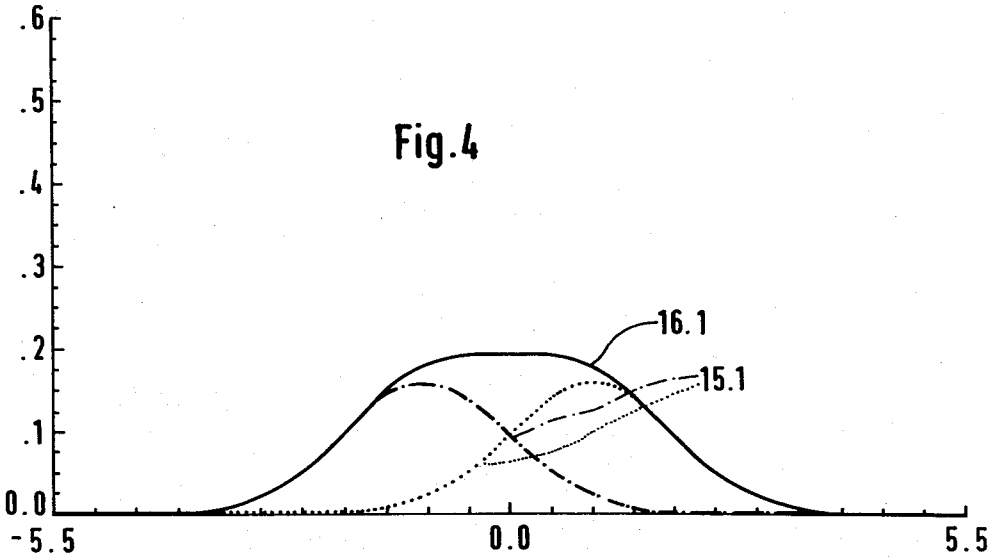
FIG. 4 illustrates a graphical representation of the hitting density for two weapons with spread apart firing impact points.

The graph as plotted in FIG. 4 illustrates the density of hits for two weapons with spread apart middle or central hitting points 6. The lines 15.1 illustrate the hitting densities of the individual weapons. The line 16.1 illustrates the common hitting density for both weapons. There can be clearly recognized a constant-remaining hitting density at a limitedly increasing offset or deviation from the middle or central hitting location.

Figure 5:
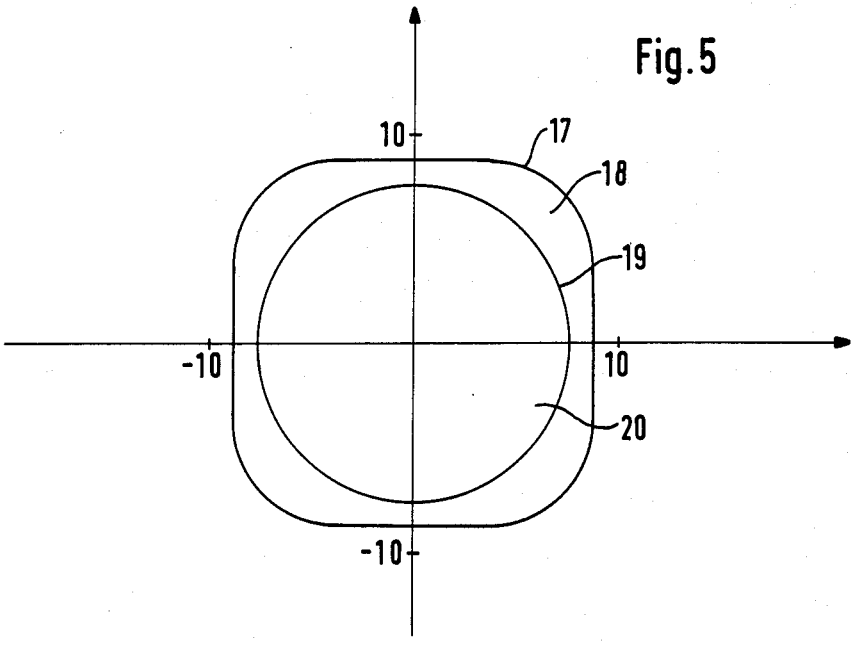
FIG. 5 illustrates a diagram of the representation of the surface with the 50% hitting probability with and without the spreading apart of the weapon barrels.

The diagram shown in FIG. 5 illustrates the representation of a surface with an at least 50% probability of firing hits in a system with spread apart weapon barrels 1, 2, 3 and 4, and without the spreading of the weapon barrels. The outer ring 17 hereby bounds the surface 18 within which there must lie the centerpoint of the target, in order to attain an at least 50% hitting probability for the system with spread apart weapon barrels; whereas the inner ring 19 represents the surface 20 with an at least 50% hitting probability for the weapon system without any spreading apart of the individual weapon barrels. The surface 18 for the spread apart system is hereby larger by about 55% than the surface 20 of the system without any spread. Selected for both systems was a firing distance of 1,000 m. The firing spread of the individual weapon barrel consisted of 3 mrad, whereas the offset, in one instance, consisted of 0 mrad and in the second instance of 3 mrad in height and towards the side.

Figure 6:
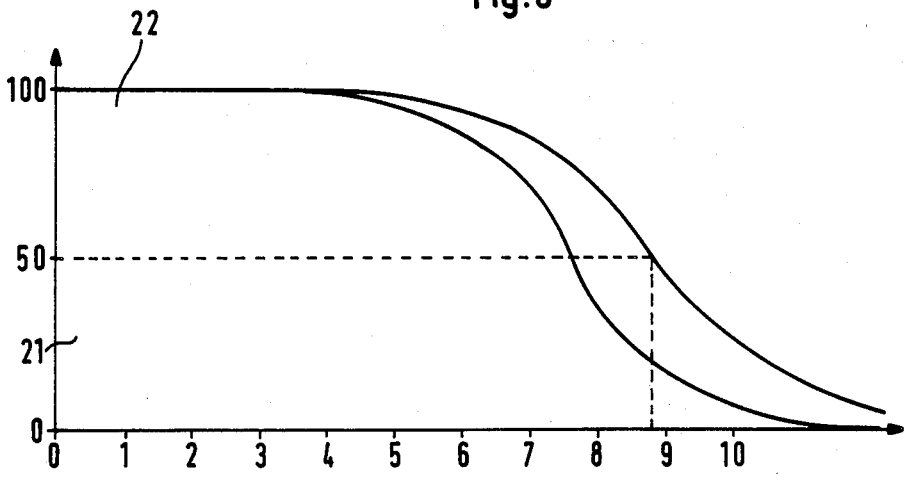
FIG. 6 illustrates a graphical representation with regard to the hitting probability plotted as a function of the target offset.

The probability of firing hits as a function of the target offset or deviation is illustrated in the graph of FIG. 6. Hereby, above all, there can be ascertained that for a system incorporating a spread, the same probabilities or hits are achieved at larger target offsets. The target or hitting surfaces are identified by reference numerals 21 and 22.

What is claimed is:

1. In a method for increasing the probability of hits from multi-barreled machine weapons, including effectuating an adjustment of the weapon barrels to achieve a predetermined spread for the hits from said weapons over target areas; the improvement comprising: associating a target area having its own middle hitting point location with each said weapon barrel; measuring a distance from a middle hitting point location for each barrel where an enclosing circle formed at said distance encloses one standard deviation of hits for each associated barrel, taking an average of said distances for the total number of barrels; orienting the hitting point locations of all of said weapon barrels at the same distance from each other and additionally at the same distance in a vertical and lateral spacing relative to the middle hitting point location of all of said weapon barrels; and then spreading the middle hitting point location of all of said weapon barrels by said average whereby the density of hits at a limited increasing deviation from the middle hitting point location of all of said weapon barrels remains at least substantially constant.

* * * * *